US012714141B2

(12) United States Patent
Kuenzel et al.

(10) Patent No.: US 12,714,141 B2
(45) Date of Patent: Aug. 25, 2026

(54) AEROSOL DELIVERY SYSTEM

(71) Applicant: Nicoventures Trading Limited, London (GB)

(72) Inventors: Johanna Kuenzel, London (GB); Patrick Moloney, London (GB); Junior Kabirat, London (GB)

(73) Assignee: Nicoventures Trading Limited, London (GB)

( * ) Notice: Subject to any disclaimer, the term of this patent is extended or adjusted under 35 U.S.C. 154(b) by 485 days.

(21) Appl. No.: 17/780,155

(22) PCT Filed: Nov. 26, 2020

(86) PCT No.: PCT/GB2020/053003
§ 371 (c)(1),
(2) Date: May 26, 2022

(87) PCT Pub. No.: WO2021/105674
PCT Pub. Date: Jun. 3, 2021

(65) Prior Publication Data

US 2023/0033181 A1 Feb. 2, 2023

(30) Foreign Application Priority Data

Nov. 29, 2019 (GB) ..... 1917438

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/51* (2020.01); *A24F 40/53* (2020.01)

(58) Field of Classification Search
None
See application file for complete search history.

(56) References Cited

U.S. PATENT DOCUMENTS 5,178,167 A 1/1993 Riggs et al.
5,865,185 A 2/1999 Collins et al.
(Continued)

FOREIGN PATENT DOCUMENTS

WO WO-2018146453 A1 8/2018
WO WO-2019141577 A1 7/2019
WO WO-2019215213 A1 11/2019

OTHER PUBLICATIONS

International Search Report and Written Opinion for Application No. PCT/GB2020/053003, mailed on Feb. 19, 2021, 15 pages.
(Continued)

*Primary Examiner* — Philip Y Louie
*Assistant Examiner* — Madeleine P Delacruz
(74) *Attorney, Agent, or Firm* — Burr & Forman

(57) ABSTRACT

An aerosol delivery device comprising a controller and a power source, wherein the device is configured to receive an article for aerosolizable material, wherein the controller is configured to facilitate generation of a first aerosol and one or more subsequent aerosols from the aerosolizable material, to determine a usage characteristic of the device and, based on said determined usage characteristic, to generate the subsequent aerosol such that it contains a pre-configured change in one or more aerosol characteristics relative to the first aerosol.

21 Claims, 4 Drawing Sheets

(51) Int. Cl.

| | |
|---|---|
| ***A24F 40/42*** | (2020.01) |
| ***A24F 40/50*** | (2020.01) |
| ***A24F 40/51*** | (2020.01) |
| ***A24F 40/53*** | (2020.01) |

(56) References Cited

U.S. PATENT DOCUMENTS

| | | | | |
|---|---|---|---|---|
| 2007/0157931 | A1 | 7/2007 | Parker et al. | |
| 2007/0186945 | A1 | 8/2007 | Olegario et al. | |
| 2015/0257445 | A1 | 9/2015 | Henry, Jr. et al. | |
| 2015/0374035 | A1 | 12/2015 | Sanchez et al. | |
| 2016/0213066 | A1 | 7/2016 | Zitzke et al. | |
| 2016/0262457 | A1 | 9/2016 | Borkovec et al. | |
| 2017/0042245 | A1 | 2/2017 | Buchberger et al. | |
| 2017/0042250 | A1 | 2/2017 | Takeuchi et al. | |
| 2017/0079329 | A1 | 3/2017 | Zitzke | |
| 2017/0238596 | A1 | 8/2017 | Matsumoto et al. | |
| 2017/0265517 | A1 | 9/2017 | Swede et al. | |
| 2018/0042308 | A1 | 2/2018 | Takeuchi et al. | |
| 2018/0132534 | A1 | 5/2018 | Reevell | |
| 2019/0008209 | A1* | 1/2019 | Bilat | A61M 11/001 |
| 2020/0268057 | A1* | 8/2020 | Sahin | A61M 15/0085 |
| 2022/0015437 | A1* | 1/2022 | Kilger | A24F 40/30 |

OTHER PUBLICATIONS

John E, et al., "Effect of Temperature and Humidity on the Gas-Particle Partitioning of Nicotine in Mainstream Cigarette Smoke: A Diffusion Denuder Study," Journal of Aerosol Science, Mar. 2018, vol. 117, pp. 100-117.

* cited by examiner

AEROSOL DELIVERY SYSTEM

RELATED APPLICATION INFORMATION

The present application is a National Phase entry of PCT Application No. PCT/GB2020/053003, filed Nov. 26, 2020, which claims priority from GB Patent Application No. 1917438.2, filed Nov. 29, 2019, each of which is hereby fully incorporated herein by reference.

FIELD

The present invention relates to an aerosol delivery system comprising an aerosol delivery device and an aerosolizable material. The present invention also relates to the aerosol delivery device of the aerosol delivery system and to methods of modulating an aerosol generated by an aerosol delivery system.

BACKGROUND

Aerosol delivery systems which generate an aerosol for inhalation by a user are known in the art. Such systems typically comprise an aerosol generator which is capable of converting an aerosolizable material into an aerosol. In some instances, the aerosol generated is a condensation aerosol whereby an aerosolizable material is heated to form a vapor which is then allowed to condense into an aerosol. In other instances, the aerosol generated is an aerosol which results from the atomization of the aerosolizable material. Such atomization may be brought about mechanically, e.g. by subjecting the aerosolizable material to vibrations so as to form small particles of material that are entrained in airflow. Alternatively, such atomization may be brought about electrostatically, or in other ways, such as by using pressure etc.

Since such aerosol delivery systems are intended to generate an aerosol which is to be inhaled by a user, consideration should be given to the characteristics of the aerosol produced. These characteristics can include the size of the particles of the aerosol, the total amount of the aerosol produced, etc.

Where the aerosol delivery system is used to simulate a smoking experience, e.g. as an e-cigarette or similar product, control of these various characteristics is especially important since the user may expect a specific sensorial experience to result from the use of the system. It would be desirable to provide aerosol delivery systems which have it control of these characteristics.

SUMMARY

In one aspect there is provided an aerosol delivery device comprising a controller and a power source, wherein the device is configured to receive an article for aerosolizable material, wherein the controller is configured to facilitate generation of a first aerosol and one or more subsequent aerosols from the aerosolizable material, to determine a usage characteristic of the device and, based on said determined usage characteristic, to generate the subsequent aerosol such that it contains a pre-configured change in one or more aerosol characteristics relative to the first aerosol.

In this regard, the present inventors have found that it is possible to modulate various characteristics of the aerosol without said changes being immediately perceptible to the user. This may be advantageous since it is then possible for the system to potentially utilize fewer resources, such as a power, aerosolizable material etc. without the user perceiving a change in experience. This can allow for a system which has increased usage times compared to systems of the prior art. For example, since the power usage of the device is reduced relative to known devices, the power source of the device may need to be charged less frequently. Further, since the amount of aerosolizable material used by the device is reduced relative to known devices, there is a reduced need to replenish the aerosolizable material which can lead to cost savings for the user and/or increase convenience.

In the context of the present disclosure, "pre-configured change" means that the controller is configured to alter the aerosol characteristics of one or more subsequent aerosols before generation of that aerosol has commenced. In this regard, it will be appreciated that such "pre-configuration" means that upon generation of the subsequent aerosol the controller will be implementing a particular set of parameters that have been "pre-configured" for the subsequent aerosol. Further, it will be understood that the specific "pre-configuration" is not necessarily fixed, but rather can be updated depending on various usage factors as described herein. Put another way, after the first aerosol is generated, but before/during generation of the one or more subsequent aerosols, the controller is configured to implement a predetermined change in one or more aerosol characteristics of the subsequent aerosols relative to the first aerosol. In the context of the present disclosure, a first aerosol is an aerosol which represents the beginning of a new inhalation session. For example, a new inhalation session may be one in which the time interval between the generation of consecutive aerosols is greater than a certain value. Purely by way of example, an inhalation session may be formed of multiple instances of aerosol generation, each instance of aerosol generation being instigated by an inhalation event. When the time interval between the generation of consecutive aerosols is relatively small, this may indicate that an inhalation session is in progress. When the time interval between the generation of consecutive aerosols is relatively large, this may indicate that all inhalation session has commenced upon generation of the latter aerosol. In other words, when the system has not generated an aerosol for a relatively greater period and then is prompted to generate an aerosol (by the user puffing on the device, or pressing an activation button etc.), this is indicative of the user not using the system and then starting to use the device, i.e. the commencement of a session. The determination of a first aerosol and a subsequent aerosol may be illustrated as follows: $t_\tau$-Af-t-$As_n$-$t_\tau$-Af Where Af is a first aerosol, $t_T$ is the time threshold past which the next aerosol is designated as a first aerosol, $t_i$ is the time interval between the generation of successive aerosols, $As_n$ is a subsequent aerosol with n being the aerosol number following the first aerosol (n=1 being the initial subsequent aerosol, n=2 being the second subsequent aerosol and so on).

As explained above, $t_\tau$ is a threshold past which the next aerosol generated will be designated as a first aerosol. Thus, in one embodiment, the next aerosol generated will be designated as a first aerosol if the time elapsed since the last aerosol generation is greater than $t_\tau$. The pre-defined threshold can be an absolute value, e.g. 1, 2, 3, 4, 5, 6, 7, 8, 9 or 10 minutes, or could be a threshold derived from a learning period. For example, the device may monitor a set of, say, 10 inhalation events and determine the average period between such events. Following this determination, any time interval which exceeds the average period will then trigger the controller to designate the next aerosol as a first aerosol. In order to ensure an aerosol is not wrongly designated as a first aerosol, the threshold may be configured to be 5, 10, 15, 20, or 25% more than the determined average period. Alternatively, a new inhalation session may be commenced by virtue of a change in device parameters, regardless of the time interval between consecutive instances of aerosol generation. For example, commencement of a new inhalation session could be prompted by a change in article/aerosolizable material being detected by the controller, or by one or more settings which affect the aerosolization of the aerosolizable material being changed, e.g. the power to delivered to an aerosol generator.

Assigning, the first aerosol allows the controller to likewise assign a subsequent aerosol. Thus, an instance of aerosol generation which is not assigned by the controller as the first aerosol is assigned by the controller as a subsequent aerosol. By assigning a first aerosol and then monitoring for the generation of a subsequent aerosol, the controller can ensure that the subsequent aerosol can be pre-configured to have a change in aerosol characteristics relative to the first aerosol.

The controller of the aerosol delivery device is configured to determine a usage characteristic of the device. For example, the usage characteristic could be one or more of a time interval between generation of a first aerosol and a subsequent aerosol, a frequency of aerosol generation over a defined period, and/or a change in an airflow profile through the device between generation of a first aerosol and a subsequent aerosol. By determining a specific usage characteristic of the device, the controller is able to select an appropriate pre-configuration for the subsequent aerosol.

The aerosol characteristics that may be changed in the subsequent aerosol relative to the first aerosol may be one or more of aerosol particle size distribution, aerosol density, aerosol partitioning, and aerosol constituents. For example, the aerosol particle size distribution of an aerosol may influence the extent to which constituents of the aerosol are deposited in the inhalation pathway of a user. In this regard, if the aerosol has a relatively lower particle size distribution, e.g. a median mass aerodynamic diameter less than 1 micron, it may be that relatively more particles of the aerosol are deposited further down the inhalation pathway.

This may lead to increased deposition of aerosol particles in the deep lung, which may lead to increased physiological uptake of any active constituents in the aerosol. Conversely, such particles may be less likely to be deposited in the buccal cavity of a user and thus, where the aerosol contains flavor constituents, it may be that the flavor intensity of such an aerosol is decreased. Similarly, where the aerosol density between the first and subsequent aerosols is changed, it may be that the user perceives a different sensorial experience. A similar consideration may also apply to the gas/particulate phase partitioning of an aerosol. For example, an aerosol is generally formed of a gas phase and a particulate phase, with the constituents of the aerosol being distributed differently between the phases based on factors known to one skilled in the art. By varying the relative partitioning of the aerosol constituents between the gas phase and particulate phase of the aerosol, it may be possible to influence the extent to which such constituents are deposited within the inhalation pathway of a user. Finally, by changing the relative proportion of aerosol constituents between the first and subsequent aerosols, it will be possible to alter the proportion of constituents such as flavor constituents or active constituents in the subsequent aerosol.

In one embodiment where the p re-configured change is a decrease, the aerosol characteristic is selected from one or more of aerosol particle size distribution, aerosol density, and aerosol constituents. In one embodiment where the pre-configured change is an increase, the aerosol characteristic is selected from one or more of aerosol particle size distribution, aerosol density, and aerosol constituents.

It will be appreciated that in the context of aerosol partitioning the pre-configured change can be an increase or decrease of the proportion of certain constituents in the gas phase.

Likewise, the pre-configured change can be an increase or decrease of the proportion of certain constituents in the particulate phase.

The pre-configured change in the aerosol characteristics may depend on the particular usage characteristics that are determined, e.g. the pre-configured change may be an increase or decrease in response to determining a particular usage characteristic. Moreover, the magnitude of the pre-configured change may be proportional to the determined usage characteristic. In one embodiment, the magnitude of the pre-configured change in one or more aerosol characteristics is proportional to the time interval between generation of a first aerosol and a subsequent aerosol. The proportionality may be direct or indirect depending on the aerosol characteristic in question. For example, where the aerosol characteristic relates to an aerosol constituent, the pre-configured change may be a decrease, and the magnitude of the pre-configured change may be indirectly proportional to the time interval between generation of a first aerosol and a subsequent aerosol. In other words, where there is a relatively smaller time interval between the generation of the first and the subsequent aerosol, the magnitude of the reduction in aerosol constituents may be greater. Conversely, where there is a larger time interval between the generation of the first and the subsequent aerosol, the magnitude of the reduction in aerosol constituents may be smaller. Such a relationship has been found to be advantageous because where a subsequent aerosol is generated shortly after a previous aerosol, it has been found that a relatively larger reduction in some aerosol constituents can be implemented without the user perceiving a change in sensorial experience. Conversely, where the subsequent aerosol is generated after a relatively longer period, the user may be able to perceive a reduction in certain aerosol constituents and as a result the pre-configured reduction needs to be smaller so as not to be perceptible to the user.

The specific change (increase or decrease) and magnitude of pre-configured change, can be selected based on the desired aerosol modulation and determined usage characteristics. For example, if a device were to be configured so as to be in a power saving mode, the controller may be configured to deliver a smaller amount of power to a device aerosol generator for a given inhalation event. The delivery of a smaller amount of power would lead to a smaller volume of aerosol being generated (other factors not changing). However, the power reduction should not be so great such that, the user will perceive the reduction aerosol volume and characterize this as a poor sensorial experience. Rather, the power reduction is tailored based on the determined usage characteristics.

In one embodiment, the controller is configured to determine whether a pre-configured change in aerosol characteristics has been perceived by the user. For example, if following a pre-configured reduction in more or more aerosol constituents (e.g. a flavor constituent) the user either increases a power setting of the device, or replaces/replenishes the aerosolizable material source, this could be an indication that the user has perceived the pre-configured change and sought to modify the device so as to reverse any reduction in sensorial experience. In such an example, the controller may be configured to record instances of device modification following a generation of a subsequent aerosol and to implement a pre-configured change of lower magnitude in a future session of inhalation events. In this manner, the controller is able to predict when the user may have perceived an aerosol with a changed aerosol characteristic and therefore establish a threshold which should not be breached in future inhalation sessions. In one embodiment, the controller is configured to generate more than one subsequent aerosol wherein each aerosol has a progressively changed aerosol characteristic relative to the previous aerosol. For example, each generated aerosol in an inhalation session may have a progressive reduction in one or more aerosol characteristics. Likewise, where the pre-configured change is an increase, each generated aerosol in an inhalation session may have a progressive increase in one or more aerosol characteristics.

Usage Characteristic

As explained above, the usage characteristic could be one or more of a time interval between generation of a first aerosol and a subsequent aerosol, a frequency of aerosol generation over a defined period, and/or a change in an airflow profile through the device between generation of a first aerosol and a subsequent aerosol.

In one embodiment, the determined usage characteristic, is a time interval between generation of a first aerosol and a subsequent aerosol. In this regard, it is noted that the time interval between the first aerosol and a subsequent aerosol must not be more than the above mentioned threshold t for determining that the next aerosol will be designated as a first aerosol. Thus, the time interval between the first aerosol and a subsequent aerosol is less than the time threshold, $t_\tau$, for determination of the first aerosol. In one embodiment, the difference between tl and $t_\tau$ is an absolute amount, for example, 5s, 10s, 20s, 30s, 40s, 50s, 51s, 52s, 53s, 54s, 55s, 56s, 57s, 58s or 59s. In one embodiment, the difference between $t_l$ and $t_\tau$ is a relative amount, for example, 5%, 10%, 20%, 30%, 40%, 50%, 60%, 70%, 80%, 90%, 91%, 92%, 93%, 94%, or 95% of $t_\tau$.

In one embodiment, the determined usage characteristic is a frequency of aerosol generation over a defined period. If the frequency of aerosol generation is high, then there will be more aerosol generating events per defined period, compared to if the frequency of aerosol generation is low. The defined period may be, for example, 30s following the generation of a first aerosol.

A explained above, the magnitude of the pre-configured change may vary depending on the usage characteristic that has been determined. In some embodiments, the magnitude is proportional to the usage characteristic. In one embodiment, the magnitude of the pre-configured change is proportional to $t_\tau/t_l$. That is to say, where $t_\tau$/tl is large (noting that it must be less than 1), the magnitude of the pre-configured change may be large. In one embodiment, the magnitude of the pre-configured change is inversely proportional to $t_\tau/t_l$. That is to say, where $t_\tau/t_l$ is large (noting that it must be less than 1), the magnitude of the pre-configured change may be small. Such a relationship may be particularly relevant where the aerosol characteristic, is aerosol constituent.

Moreover, in one embodiment, the magnitude of the pre-configured change is proportional to the frequency of aerosol generation. That is to say, where the frequency of aerosol generation is high, the magnitude of the pre-configured change may be large. Frequency of aerosol generation (puffing/inhalation events) may be determined based on a measured average aerosol generation frequency. This average frequency may be determined and stored in the device. For example, the device may determine that aerosol generation occurs on average 10 times per 60 seconds. A departure from the average frequency may therefore indicate a relatively "high" or "low" aerosol generation frequency. In one embodiment, a high frequency of aerosol generation may be considered to be 10% or more increase in aerosol generation frequency from the average. In some embodiments, the increase from the average frequency may be 15% or more, 20% or more, 25% or more, 30% or more, 35% or more, 40% or more, 45% or more, 50% or more, 55% or more, 60% or more, 65% or more, 70% or more, 75% or more, 80% or more, 85% or more, 90% or more, 95% or more, 100% or more.

In one embodiment, the magnitude of the pre-configured change is inversely proportional to the frequency of aerosol generation. That is to say, where the frequency of aerosol generation is large, the magnitude of the pre-configured change may be small. Such a relationship may be particularly relevant where the aerosol characteristic is aerosol constituent.

Further, in one embodiment, the magnitude of the pre-configured change is proportional to the magnitude of a change in an airflow profile through the device between generation of a first aerosol and a subsequent aerosol. For example, if a user inhales through the device with a flow rate during the generation of a first aerosol and then inhales through the device with a flow rate $F_2$ during the generation of a subsequent aerosol, the magnitude of the difference between and $F_2$ can be determined by the controller and used to implement a proportional pre-configured change in one or more aerosol characteristics. In this regard, the magnitude of the pre-configured change may be proportional to whether the flow rate difference is positive or negative, i.e. whether the flow rate between aerosols has increased or decreased. A decreased flow rate may be indicative of a desire for a reduced sensorial experience. Thus, in one embodiment, where the flow rate difference is positive (faster during generation of subsequent aerosols), the pre-configured change results in an increase in aerosol density and/or aerosol constituents (in particular aerosol constituent concentration). In one embodiment, where the flow rate difference is negative (slower during generation of subsequent aerosols), the pre-configured change results in an decrease in aerosol density and/or aerosol constituents (in particular aerosol constituent concentration).

Aerosol Characteristics

The aerosol characteristics that may be modulated according to the present disclosure may be selected from one or more of aerosol particle size distribution, aerosol density, aerosol partitioning, and aerosol constituents.

For example, in the context of aerosol particle size distribution (mass median aerosol diameter), the pre-configured change may be an increase or decrease in the aerosol particle size distribution. In one embodiment, the one or more subsequent aerosols may have a change (either increase or decrease) in mass median aerosol diameter of greater than 0.1 pm, greater than 0.2 pm greater than 0.3 pm, greater than 0.4 pm, greater than 0.5 pm, greater than 0.6 pm, greater than 0.7 pm, greater than 0.8 pm, greater than 0.9 pm, greater than 1.0 pm, greater than 2.0 pm, greater than 3.0 pm, greater than 4.0 pm, or greater than 5.0 pm.

Various means for modulating aerosol particle size distribution are known to one skilled in the art. For example, a device may have multiple aerosol generators, each of which designed to generate an aerosol having a particular particle sire. Thus, where a first aerosol and a subsequent aerosol are to have differing aerosol particle size distributions, the appropriate aerosol generator can be used of each aerosol. In devices which do not contain multiple aerosol generators, particle size can be influenced in other ways, such as by varying the airflow path the aerosol takes following generation. In non-heated systems, such as where the aerosol is generated via mechanical means (via e.g. a piezo/vibrating atomizer), it may be possible to modulate the particle size by varying the frequency of vibration. Similar approaches can be taken for aerosols generated via spraying techniques (whereby the pressure applied at a nozzle/nozzle aperture dimensions may be varied).

In the context of aerosol density, the pre-configured change may be an increase or decrease in aerosol density. For example, the first aerosol may have a higher aerosol density compared to the one or more subsequent aerosols. Alternatively, the first aerosol may have a lower aerosol density compared to the one or more subsequent aerosols. In this regard, aerosol density is determined as the total aerosol collected mass ("ACM") generated when a single aerosol is generated. A decrease in ACM is indicative of a decrease in aerosol density for a given device. Likewise, an increase in ACM is indicative of an increase in aerosol density for a given device. In one embodiment, the pre-configured change in aerosol density is a decrease. In one embodiment, the pre-configured change in aerosol density is an increase. In one embodiment, the pre-configured change in aerosol density may be an increase of greater than 0.1 mg, greater than 0.2 mg, greater than 0.3 mg, greater than 0.4 mg, greater than 0.5 mg, greater than 0.6 mg, greater than 0.7 mg, greater than 0.8 mg, greater than 0.9 mg, greater than 1.0 mg, greater than 1.5 mg, greater than 2.0 mg, greater than 2.5 mg, or greater than 3.0 mg ACM.

It will be appreciated that the controller can be pre-programmed so as to retain a particular power delivery which corresponds to an intended target ACM. In this regard, empirical testing can be carried out on exemplary devices to determine the relative relationship between, for example, power delivery to the aerosol generator and resulting ACM. Factors that may be taken into account include the type of aerosol generator being used, the type of aerosolizable material being used, and also the feed rate of the aerosolizable material to the aerosol generator. An article containing a known aerosolizable material, aerosol generator and maximum feed rate of aerosolizable material can be provided with an identifier (such as RFID chip, barcode, QR code, etc.) which can be read by the controller (or a sensor which reports to the controller) so as to allow the controller to select the appropriate power delivery setting for that article. In one embodiment, power settings are correlated to ACM in a lookup table stored in memory accessible to the controller, such that the controller can determine the appropriate power setting in order to deliver the pre-configured change in ACM. A similar correlation can be provided between power delivery and other aerosol characteristics that are to be modulated.

In the context of aerosol partitioning, the pre-configured change may be a change in the relative proportions of particulate phase and as phase which make up the aerosol, a change in the distribution of one or more aerosol constituents within either the gas phase or the particular phase, or both. For example, the pre-configured change may be an increase in the percentage of an active constituent, e.g. nicotine, which resides in the particulate phase of the aerosol. For example, the first aerosol may comprise nicotine and greater than 99.0% of the nicotine in that aerosol may be located in the particulate phase. The one or more subsequent aerosols may comprise either an increase or decrease in the % of aerosol nicotine that resides in the particulate phase. Thus, the total amount of nicotine in the aerosol has not changed, but the partitioning of that nicotine between the particulate phase and the gas phase has.

In one embodiment, the pre-configured change in aerosol partitioning is a change in the percentage of the aerosol being in the particulate phase. In one embodiment, the change is an increase in the amount of aerosol being in the particulate phase. In one embodiment, the change is a decrease in the amount of aerosol being in the particulate phase. In one embodiment, the percentage change (either increase or decrease) of particulate phase is greater than 0.1%, greater than 0.2%, greater than 0.3%, greater than 0.4%, greater than 0.5%, greater than 0.6%, greater than 0.7%, greater than 0.8%, greater than 0.9%, greater than 1.0%, greater than 1.5%, greater than 2.0%, greater than 2.5%, greater than 3.0%, greater than 4.0%, greater than 5.0%, greater than 10.0%, or greater than 15.0%.

In one embodiment, the pre-configured change in aerosol partitioning is a change in the distribution of one or more aerosol constituents (described further below) in the particulate phase. In one embodiment, the change is an increase in one or more aerosol constituents being in the particulate phase. In one embodiment, the change is a decrease in one or more aerosol constituents being in the particulate phase. In one embodiment, the percentage change (either increase or decrease) of one or more aerosol constituents being in the particulate phase is greater than 0.1%, greater than 0.2%, greater than 0.3%, greater than 0.4%, greater than 0.5%, greater than 0.6%, greater than 0.7%, greater than 0.8%, greater than 0.9%, greater than 1.0%, greater than 1.5%, greater than 2.0%, greater than 2.5%, greater than 3.0%, greater than 4.0%, greater than 5.0%, greater than 10.0%, or greater than 15.0%. In one embodiment, the aerosol consistent is an active constituent, such as nicotine.

In one embodiment, the aerosol constituent is a flavor constituent.

The skilled person knows how to modify both the balance of particulate phase and gas phase of an aerosol, and the relative distribution of aerosol constituents within the aerosol. For example, nicotine in an aerosol can be present in either a "free base" form, whereby the nitrogen atoms of the nicotine molecule are uncharged (also referred to as "non-protonated"), or in a "protonated" form, whereby the nitrogen atoms of the nicotine molecule are charged (due to association with a proton). Such "protonated" nicotine may be more likely to reside within the particulate phase of an aerosol. Thus, the skilled person is able to produce a first aerosol which may contain nicotine in a free base form, and one or more subsequent aerosols which contains nicotine in protonated form (of vice versa). The ability to vary the extent to which a particular aerosol contains protonated or non-protonated nicotine can be achieved in various ways. For example, it may be possible to deliver different aerosolizable materials to an aerosol generator at different times/different rates so as to vary the relative proportion of protonated or non-protonated nicotine in the aerosol. The required delivery profiles for specific aerosolizable materials to deliver specific aerosol profiles from specific devices can be empirically derived and then stored in the device for later application by the controller. Determination of particulate phase/gas phase nicotine in an aerosol can be achieved by methods known to those skilled in the art. Similar considerations apply to the distribution of other aerosol constituents, such as other active constituents and/or flavor constituents.

In one embodiment, the one or more subsequent aerosols may have a pre-configured change (either increase or decrease) in the type and/or amount of aerosol constituents (described further below). In this regard, a first aerosol may comprise a first aerosol constituent, e.g. one type of flavor constituent, and one or more subsequent aerosols may contain a different aerosol constituent, e.g. a different type of flavor constituent. Additionally and/or alternatively, a first aerosol may comprise an amount, of a first aerosol constituent, and one or more subsequent aerosols may contain a different amount of said first aerosol constituent. In one embodiment, the one or more subsequent aerosols may contain a pre-configured decrease in the amount of one or more aerosol constituent. In one embodiment, the one or more subsequent aerosols may contain a pre-configured increase in the amount of one or more aerosol constituent. For example, where the aerosol constituent is an active constituent, such as nicotine, the one or more subsequent aerosols may contain a pre-configured change (for example reduction) in the amount of nicotine present in the aerosol. It may be advantageous for the controller to implement such a pre-configured change in circumstances whereby the user wishes to reduce the amount of a particular aerosol constituent, such as nicotine, they are consuming during an inhalation session.

In one embodiment, the pre-configured change in the amount of the aerosol constituent between the first aerosol and the one or more subsequent aerosols may be greater than 0.1 mg, greater than 0.2 mg, greater than 0.3 mg, greater than 0.4 mg, greater than 0.5 mg, greater than 0.6 mg, greater than Q.7 mg, greater than 0.8 mg, greater than 0.9 mg, greater than 1.0 mg, greater than 1.5 mg, greater than 2.0 mg, greater than 2.5 mg, or greater than 3.0 mg.

Aerosol constituents according to the present disclosure includes different types of constituents that may be present in the aerosolizable material and subsequently are aerosolized to form the aerosol. For example, the aerosolizable material (and thus the aerosol constituents) can comprise active constituents, flavor constituents, carrier constituents and/or other constituents.

Examples of active constituents include nicotine (optionally contained in tobacco or a tobacco derivative) or one or more other physiologically active materials, such as caffeine vitamins etc. A physiologically active material is a material which is included in the aerosolizable material in order to achieve a physiological response other than olfactory perception. References to nicotine or other active constituents include those actives in pharmaceutically acceptable salt form.

Examples of flavor constituents include materials which, where local regulations permit, may be used to create a desired taste or aroma in a product for adult consumers. They may include one or more of extracts (e.g, licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfarne potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

Examples of carrier constituents include one or more of water, glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

Other aerosol constituents of the aerosolizable material (which are then transferred to the aerosol) may include pH regulators, stabilizers, and/or antioxidants. In particular, the other aerosol constituents may include one or more acids selected from organic or inorganic acids. An example of an inorganic acid is phosphoric acid. The organic acid may be include a carboxylic acid. The carboxylic acid may be any suitable carboxylic acid. In one embodiment the acid is a mono-carboxylic acid. In one embodiment the acid may be selected from the group consisting of acetic acid, lactic acid, formic acid, citric add, benzoic acid, pyruvic acid, levulinic acid, succinic acid, tartaric acid, oleic acid, sorbic add, propionic acid, phenylacetic acid, and mixtures thereof. As explained above, the presence of an acid may serve to "protonate" any nicotine (or relevant constituent) present in the aerosolizable material (and subsequently in the generated aerosol).

It should be noted that any one of the above types of specific constituents may be present alone in an aerosolizable material.

In one embodiment, the device may be configured to generate aerosols from different sources of aerosolizable material. The different sources may comprise stores of aerosolizable material. The stores may comprise the same aerosolizable material, or the stores may comprise different aerosolizable materials. Where the stores contain the same aerosolizable material, the aerosolizable materials may be delivered to different aerosol generators having the ability to produce aerosols with different aerosol characteristics. Where the stores contain different aerosolizable materials the aerosolizable materials may be delivered at different times/rates to either a single or multiple aerosol generators so as to generate aerosols with different aerosol characteristics. For example, one store might comprise an aerosolizable material comprising an active constituent (such as nicotine) and one or more carrier constituents (such as glycerol and or propylene glycol), and another store may comprise one or more flavor constituents and/or one or more other constituents. During operation, the controller can then be configured to facilitate a change in the relative proportion of aerosolizable material that is aerosolized from each store, thus changing the aerosol characteristics of the aerosol. Such an approach can be used to modify the flavor type/intensity of subsequent aerosols. A similar approach could also be used to modify the percentage of nicotine in the aerosol that is in a certain phase (by selectively aerosolizing a protonating acid, the nicotine in the aerosol will become protonated to a corresponding degree and thus it is possible to modify the partitioning of the nicotine in the aerosol).

Subsequent Aerosols

As described herein, the controller of the aerosol delivery device is configured to, in response to the determination of specific user characteristics, generate the one or more subsequent aerosol(s) such that it (they) contain a pre-configured change in one or more aerosol characteristics relative to the first aerosol.

In one embodiment die pre-configured change is applied only to the aerosol produced consecutively after the first aerosol (a "one-off" change). The pre-configured change may not be implemented until one or more subsequent aerosols following the first aerosol have been generated. For example, the pre-configured change may be implemented in the second, third, fourth, fifth, sixth, seventh, eighth, ninth or tenth aerosol following the generation of the first aerosol. Alternatively, in one embodiment, the pre-configured change is maintained (or "fixed") for all subsequent aerosols following the first aerosol. Alternatively, the pre-configured change may be a continuous "step-wise" change for each subsequent aerosol produced after the first aerosol. Such a continuous change may continue until the point at which the controller designates the next aerosol to be generated as a first aerosol.

In this regard, it may be that after the pre-configured change has been implemented in the one or more subsequent aerosols (either in a "fixed" implementation or a "step-wise" implementation), the controller is configured to either revert back to the production of an aerosol having the same (or substantially the same) aerosol characteristics as a previous first aerosol, or to revert back to the production of an aerosol having the same (or substantially the same) aerosol characteristics as on or more of the preceding aerosols. For example, it may be that a first aerosol is produced having a specific amount of a certain aerosol constituent, such as nicotine. Based on the time interval between the generation of the first aerosol and the next subsequent aerosol, the controller is configured to generate the subsequent aerosol such that it contains a pre-configured reduction in the amount of nicotine in the subsequent aerosol. This reduction could then continue for each of the subsequent aerosols until such time that the controller determines that the next aerosol is to be a first aerosol. The controller may then be configured to generate a first aerosol which has either substantially the same amount of nicotine as the previous first aerosol, or has a reduced amount of nicotine compared to the first aerosol (but still more than the aerosol just generated). Such a configuration can allow for the sequential stepping down of nicotine per inhalation during an inhalation session, but then allow for the controller to revert back to a starting nicotine amount for the first aerosol of the next inhalation session which is less than that for the initial first aerosol. Over time, implementation of such a continuously reducing amount of nicotine may allow a user to reduce their consumption of a particular aerosol constituent, such as nicotine, without perceiving such a reduction either during an inhalation session (because the nicotine amount has been gradually and imperceptibly stepped down) or at the start of an inhalation session (because the nicotine amount has been stepped up relative to the end of the previous session). A similar pattern of continuous step-wise change (either increase or decrease) during a session followed by an opposite (as appropriate) change at the start of a new inhalation session can be applied to any of the aerosol characteristics disclosed herein.

Thus, in one embodiment, the controller is configured to implement a gradual change (increase or decrease) in one or more aerosol characteristics of one or more subsequent aerosols, followed by a stepped change in the opposite direction.

It may be that the controller is configured to implement the pre-configured change in aerosol characteristics a pre determined time after generation of the first aerosol. Thus, the preconfigured change does not have to be linked to a particular aerosol number following a first aerosol, but rather may be determined based on a predetermined time. The pre-determined time may be a finite time following on from the generation of a first aerosol, for example, 30s, 1 m, 2 m, 3 m, 4 m, 5 m, 6 m, 7 m, 8 m, 9 m, or 10 m. Alternatively, the pre-determined time may be a cumulative time during which aerosol has been generated following the commencement of an inhalation session. For example, the controller may be configured to monitor the total time that power has been delivered to the aerosol generator such that when a particular cumulative time of aerosol generation has been reached, the controller commences implementation of the pre-configured change in aerosol characteristics for the one or more subsequent aerosols. In this regard, the controller may be pre-programmed with pre-set cumulative time periods which will trigger the implementation of the pre-configured change, e.g. 10 s, 20 s, 30 s, 40 s, 50 s, 1 m, 2 m, 3 m, 4 m, 5 m, 6 m, 7 m, 8 m, 9 m, 10 m, 15 m, 20 m, or 30 m. Such an approach may be advantageous in circumstances where the user has become overly accustomed to the particular characteristics of the aerosol being produced by the device. By commencing the pre-configured change after a pre-determined period of time, the user can be provided with an imperceptible reduction in, for example, a particular aerosol constituent (such as a flavor) such that when the next first aerosol is designated, it can have aerosol characteristics (such as flavor) which have been stepped back up and thus provide the user with a relatively enhanced sensorial experience.

It is also possible for the controller to be configured to monitor usage characteristics of the device and to infer when it should commence the pre-configured change in aerosol characteristics. For example, in the situation mentioned above whereby a user may become overly accustomed/sensitive to a particular aerosol, they may inadvertently modify their inhalation behavior, e.g. they may reduce the intensity and/or frequency with which they use the device. The controller might determine this by receiving an input from an airflow sensor which indicates that the user is puffing with less intensity (the flow rate is reduced) than for previous instances of aerosol generation. In such a scenario, the controller may be configured to implement the pre-configured reduction in one or more aerosol characteristics for the subsequent aerosols. The controller could also calculate the cumulative time taken for this reduction in intensity to occur such that for future inhalation sessions, the pre-configured change occurs before the user has had to change the intensity with which they use the device.

In a further aspect there is provided an aerosol delivery system comprising the aerosol delivery device described herein and an article for aerosolizable material.

In a further aspect there is provided an aerosol delivery device configured to receive an aerosolizable material and comprising a controller, the controller being configured to facilitate generation of a first aerosol and one or more subsequent aerosols, wherein the subsequent aerosols) is configured so as to be modified relative to the first aerosol without said modification being perceptible to the user.

In a further aspect there is provided a method of modulating an aerosol generated by an aerosol delivery system, the method comprising the steps of: providing an aerosol delivery device comprising a controller and a power source, wherein the device comprises an article for aerosolizable material; determining a usage characteristic of the device, generating a first aerosol; generating one or more subsequent aerosols, wherein the one or more subsequent aerosols contains a pre-configured change in one or more aerosol characteristics relative to the first aerosol based on the determined usage characteristic.

The disclosures made above relating to an aerosol delivery device apply equally to the aspect of the above mentioned method. They are not repeated here in the interests of brevity, but this should not be construed as implying that such described features cannot apply equally to the method.

These aspects and other aspects of the present invention will be apparent from the following detailed description. In this regard, particular sections of the description are not to be read in isolation from other sections.

BRIEF DESCRIPTION OF THE DRAWINGS

Various embodiments will now be described in detail by way of example only with reference to the accompanying drawings in which.

DETAILED DESCRIPTION

As described above, in one aspect there is provided an aerosol delivery device comprising a controller and a power source, wherein the device is configured to receive an article for aerosolizable material, wherein the controller is configured to facilitate generation of a first aerosol and one or more subsequent aerosols, to determine a usage characteristic of the device and, based on said determined usage characteristic, to generate the subsequent aerosol such that it contains a pre-configured change in one or more aerosol characteristics relative to the first aerosol.

Figure 1:
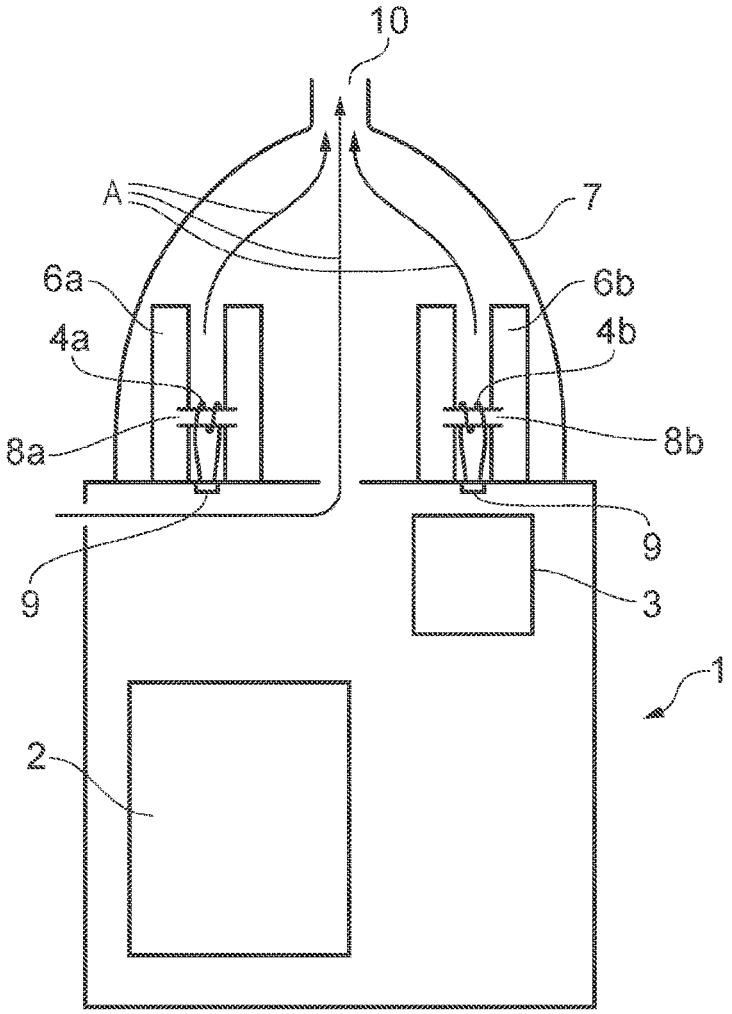
FIG. 1 shows an exemplary aerosol delivery device in accordance with some embodiments of the present disclosure.

In an exemplary embodiment, as shown in FIG. 1, there is provided an aerosol delivery device 1 comprising a power source 2 and a controller 3. The device 1 may also comprise an aerosol generator 4. The aerosol generator 4 may comprise multiple units (such as heaters) which are able to separately generate aerosols having different aerosol characteristics. For example, aerosol generator 4 comprises heater 4*a* and heater 4*b* each of which being configured to vaporize an aerosolizable material. Alternatively, the aerosol generator may comprise a single unit (such as a heater) which is able to generate sequential aerosols having different aerosol characteristics. It is also within the scope of the present disclosure to provide a power source 2 which is detachable from the device 1. Thus, the present disclosure also encompasses, in all embodiments, the device without the power source such that a control unit for an aerosol delivery device is provided.

The aerosolizable material can be stored within a store 6 for aerosolizable material. The store 6 may be part of an article 7 which may be detachable from the device such that the article 7 can be replaced when the store of aerosolizable able material has been depleted. It may also be possible to replenish the store of aerosolizable material by refilling the store 6 with aerosolizable material. In some embodiments, there may be multiple stores, such as store 6*a* and store 6*b* containing the same or different aerosolizable material. Such an arrangement can allow for the heaters to be fed either with aerosolizable material either at different rates, or with different aerosolizable materials etc. so as to facilitate as one example a way of generating sequential aerosols with different aerosol characteristics.

Aerosolizable material may be transferred from the store to the aerosol generator via a transport element 8 such as a wick, pump or the like. For example, heaters 4*a* and 4*b* are fed from stores 6*a* and 6*b* with aerosolizable material via transport elements 8*a* and 8*b* respectively. The skilled person is able to select suitable transport, elements depending on the type of aerosolizable material that is to be transported and the rate at which it must be supplied. Particular mention may be made of transport elements, such as wicks, formed from fibrous materials, foamed materials, woven and non-woven materials. Such materials may include silica, cotton, ceramics and the like. In this regard, it will be appreciated by one skilled in the art that a higher ACM for a particular inhalation event can be achieved by increasing the amount of power supplied to a heater of the aerosol generator. However, such increased power may require an increased supply of aerosolizable material and as such the controller may be configured to match the supply rate of the aerosolizable material to the power being conveyed to the heater.

In some embodiments, the article 7 also incorporates the aerosol generator 4, such that both the store 6 and the aerosol generator 4 are detachable from the device when the article 7 is detached. In such embodiments, both the article 7 and the device 1 contain suitable electrical connections (not shown) between the power source 2, controller 3, aerosol generator 4, (and optionally the transport element 8) which allow for the supply of electrical energy to the various components during use. Contacts 9 provide a means to provide electrical energy between the device 1 and the power source 7. It is also envisaged that energy could be imparted to the aerosol generator via other methods, such as via induction, in which case contacts 9 to provide electrical energy to the aerosol generator would not be required.

An airflow pathway extends through the article (optionally via the device) to an outlet 10. The pathway is oriented such that generated aerosol is entrained in the airflow A such that it can be delivered to the outlet 10 for inhalation by a user. During operation, the controller will determine that a user has initiated the generation of an aerosol. This could be done via a button (not shown) on the device 1 which sends a signal to the controller 3 that the aerosol generator should be powered. Alternatively, a sensor (not shown) located in or proximal to the airflow pathway could detect airflow through the airflow pathway and convey this detection to the controller. A sensor may also be present in addition to the presence of a button, as the sensor may be used to determine certain usage characteristics, such as airflow, timing of aerosol generation etc.

Controller 3 will now be described. Controller 3 may comprise an MCU which receives inputs from various sources throughout the device and subsequently controls operation of the device, for example, the one or more aerosol generators present either in the device or in the article. The controller may also control other components of the device, such as the flow of aerosolizable material to the one or more aerosol generators, the airflow through the device etc. In this regard, the device and/or the article may include one or more valves. Such valves may control the flow of aerosolizable material from the store(s) to the aerosol generators, and/or may control airflow through the device. For example, valves that control the feeding of aerosolizable material may be able to control the feed rate of one or more aerosolizable materials. Controlling the feed rate includes preventing any feed selectively feeding from one or more stores of aerosolizable material, for example where there are multiple stores of aerosolizable material, the controller may direct the valves to only allow feeding from a single store. As explained above, controlling the feed rate of one or more aerosolizable materials may be important where the controller is implementing a change in, for example, ACM of the aerosol to be generated. Further, valves that control the airflow through the device/article allow for the modulation of aerosol particle size distribution.

The controller may also have access to a memory whereby information relevant to the operation of the device can be stored, retrieved and/or updated as appropriate. The memory may be part of the controller, or may be part of a remove device which the controller is able to communicate with (for example via some form of wired or wireless connection). The controller also includes/has access to a timer via which certain usage characteristics can be determined, e.g, length of time between instances of aerosol generation, length of individual instances of aerosol generation etc. The controller may also be able to determine the date and actual time, i.e. time of day, of particular usage characteristics and use such information to pre-configure the aerosol characteristics of the one or more subsequent aerosols. For example, the controller may be able to operate in plurality of modes which are correlated to the time of day. In this way, the direction and/or magnitude of the pre-configured change in the aerosol characteristics of one or more subsequent aerosols can be altered not only on the determined usage characteristics, but also on the point in time at which the device is being used. For example, it may be that the magnitude of the pre-configured changed is correlated to whether the device is being used in the morning, afternoon or evening. Since a user's ability to perceive changes in aerosol characteristics may evolve throughout a day, the controller may be configured to take into account the time of day when implementing a particular pre-configured change. Likewise, other elements of usage characteristics may be taken into account, such as location of use.

Figure 2:
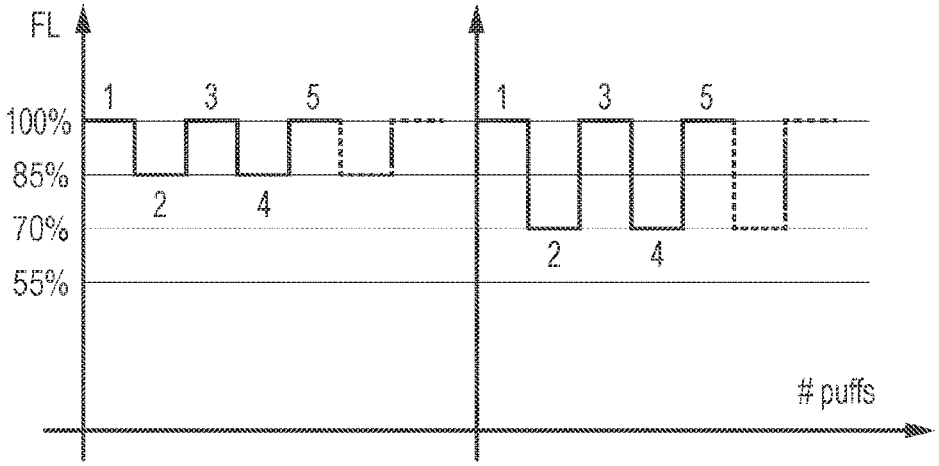
FIG. 2 provides a graph detailing the relative amount of a particular aerosol constituent between first (left hand trace) and subsequent aerosols (right hand trace).

Further, the controller may include/have access to one or more, usage sensors which provide information regarding the usage characteristics of the device and/or the aerosol characteristics. Such usage sensors include airflow rate sensors, barometric pressure sensors, contact pressure sensors, humidity sensors, temperature sensors, motion sensors, location sensors and the like. Referring now to FIG. 2, a graph is shown whereby the amount of a particular aerosol constituent (such as a flavor—FL referring to Flavor Level)) is reduced between first and subsequent aerosols. In particular, the left hand half of the graph shows a first aerosol 1 and a subsequent aerosol 2. In particular, aerosol 1 contains a relative amount of 100% of a flavor constituent, whereas aerosol 2 contains a relative amount of 85% of that same flavor constituent. For aerosol 3, the amount of flavor constituent increases again to 100%. This cycling of decreasing and then increasing the amount of flavor constituent between throughout the aerosol session can result in a net reduction in the amount of flavor constituent consumed by the user, which could be advantageous, e.g. for cost reasons. Since, however, the preconfigured change has an undulating profile, the user is only exposed to a reduction in flavor constituent 50% of the cycle and thus has reduced opportunity to perceive a difference in sensorial experience. The right hand side of the graph in FIG. 2 shows a similar undulating profile, however in this instance the controller is configured to reduce the flavor constituent of the aerosol immediately after the first aerosol to 70% of the initial relative value.

Figure 3A:
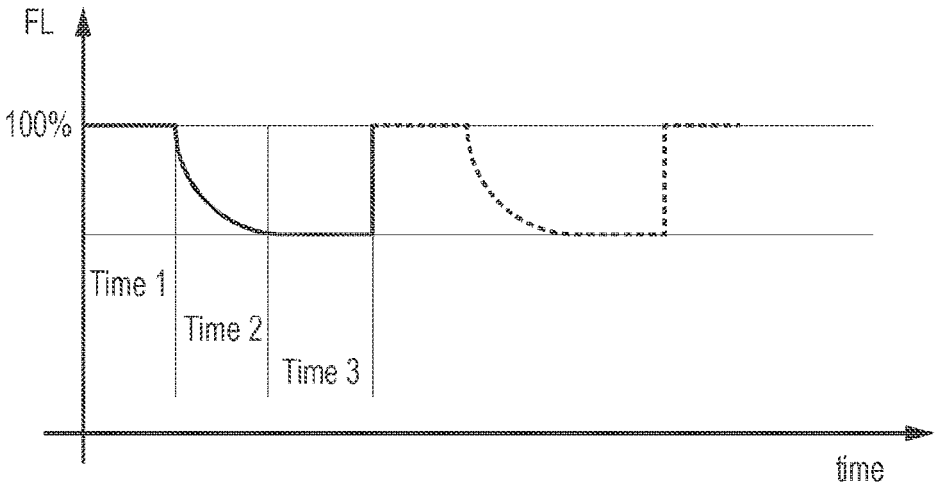
FIGS. 3*a* and 3*b* show graphs detailing how the pre-configured step change in aerosol characteristics may vary in time after the first aerosol is generated.
Figure 3B:
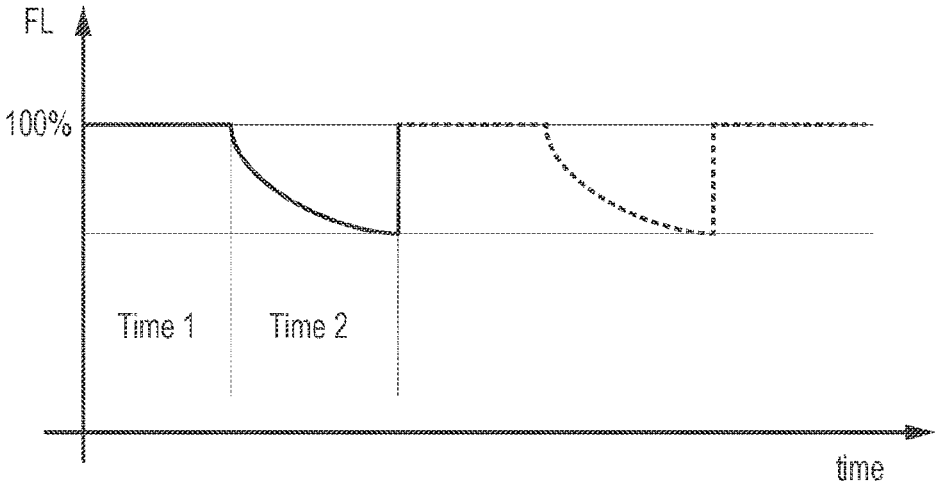

FIGS. 3*a* and 3*b* show how the controller may be configured to vary the point in time after the first aerosol is generated that the pre-configured step change in aerosol characteristics may occur. For example, in FIG. 3*a*, the controller is configured to maintain the aerosol characteristics unchanged until time 1 and then to implement a relatively gradual change in aerosol characteristics (reduction in this example) over the period of time 2. FIG. 3*b* shows an example of an implementation whereby the controller is configured to implement a relatively rapid change in aerosol characteristics (reduction in this example) followed by a fixed period whereby consecutive aerosols are produced with "fixed" aerosol characteristics.

Figure 4:
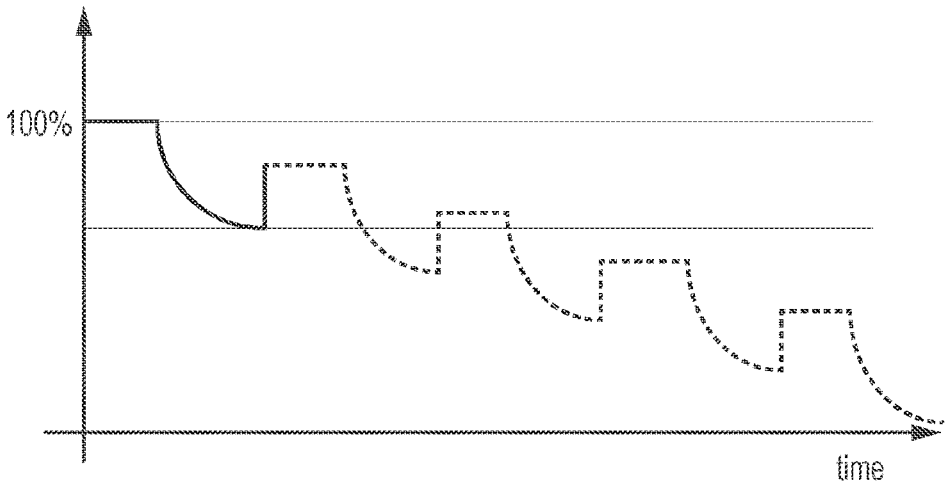
FIG. 4 shows how a controller according to some embodiments may be configured to implement a staggered stepping-down of an aerosol constituent.

FIG. 4 shows how the controller may be configured to implement a continuous stepping-down of an aerosol constituent, implemented in a staggered way. In particular, following an initial period whereby aerosols of "fixed" aerosol characteristics are generated, the controller is then configured to begin a step-wise reduction in an amount of aerosol constituent for consecutive aerosols generated over an individual session. At each determination that the next aerosol to be generated is a first aerosol, the controller is configured to increase the amount of the aerosol constituent to a level above that of the last aerosol, but less than that of the previous first aerosol. This cycle can then be repeated until that particular aerosol constituent is substantially absent from all subsequent aerosols, including first aerosols. The various aerosol characteristics can be determined according to known methods. Suitable methods in this regard are explained below.

Aerosol Collected Mass

The total collected aerosol mass (ACM) for each aerosol is determined by measuring the amount of aerosol captured on a Cambridge filter pad before and after each collection event. The total amount of aerosol collected will be determined by difference in mass (Pad weight after collection—pad weight before collection). In order to determine the total collected aerosol mass for a range of different aerosols, the aerosol collection time period should be constant, e.g. 3 second aerosol generation period.

Determination of Gas Phase and Particulate Phase Content

There are various methods available for determining the particulate/gas phase partitioning of an aerosol. Briefly, the aerosol can be collected on a series of Cambridge Filter Pad (CFP) and Impingers. The mass of the pre and post collection is determined, with the difference being indicative of the particulate phase. The Impinger gives an indication of the gas phase. It is also possible to determine the particulate/gas phase partitioning of an aerosol using a denuder, using a method as described in John et al., Journal of Aerosol Science, Volume 117, March 2018, Pages 100-117, modified so as to facilitate use with an electronic aerosol provision system.

Determination of Particle Size Distribution (MMAD)

There are various methods available for determining the mass median aerodynamic diameter (MMAD) of an aerosol. Mention may be made of cascade impaction and laser scattering/diffraction. A suitable system for use to determine the MMAD via laser scattering/diffraction includes a Spraytec laser diffraction system from Malvern Panalytical.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An aerosol delivery device comprising a controller and a power source, wherein the device is configured to receive an article for aerosolizable material, wherein the controller is configured to facilitate generation of a first aerosol and one or more subsequent aerosols from the aerosolizable material, to determine a usage characteristic of the device and, based on said determined usage characteristic, to generate the subsequent aerosol such that it contains a pre-configured change in one or more aerosol characteristics relative to the first aerosol, wherein the usage characteristic is a time interval between generation of the first aerosol and the subsequent aerosol.

2. The aerosol delivery device according to claim 1, wherein the pre-configured change is a pre-configured reduction or a pre-configured increase.

3. The aerosol delivery device according to claim 2, wherein the pre-configured reduction in one or more aerosol characteristics is proportional to the time interval between generation of a first aerosol and a subsequent aerosol.

4. The aerosol delivery device according to claim 3, wherein the pre-configured reduction in one or more aerosol characteristics is directly proportional to the time interval between generation of a first aerosol and a subsequent aerosol or inversely proportional to the time interval between generation of a first aerosol and a subsequent aerosol.

5. The aerosol delivery device according to claim 2, wherein the pre-configured reduction in one or more aerosol characteristics is proportional to a frequency of aerosol generation over a defined period.

6. The aerosol delivery device according to claim 5, wherein the pre-configured reduction in one or more aerosol characteristics is directly proportional to the frequency of aerosol generation over a defined period or inversely proportional to the frequency of aerosol generation over a defined period.

7. The aerosol delivery device according to claim 1, wherein the controller is configured to detect the presence, quantity and/or type of aerosolizable material received in the device.

8. The aerosol delivery device according to claim 1, wherein the first aerosol is characterized based on one or more of: a first time interval since the generation of a previous aerosol; a first inhalation event following the insertion of an aerosolizable material into the device; and a first inhalation event following modification of one or more parameters relating to aerosol generation.

9. The aerosol delivery device according to claim 1, wherein the one or more aerosol characteristics are selected from one or more of aerosol particle size distribution, aerosol density, aerosol partitioning, and aerosol constituents.

10. The aerosol delivery device according to claim 9, wherein the pre-configured change is a pre-configured decrease in one or more aerosol constituents or a pre-configured increase in the aerosol particle size distribution and/or the aerosol density.

11. The aerosol delivery device according to claim 10, wherein the aerosol constituents are selected from active constituents, flavor constituents, carrier constituents and/or other constituents.

12. The aerosol delivery device according to claim 1, wherein controller is configured to implement the pre-configured change by modifying one or parameters relating to aerosol generation selected from power delivered to the aerosol generator, airflow to the aerosol generator, feed rate of aerosolizable material to the aerosol generator and composition of aerosolizable material fed to the aerosol generator.

13. The aerosol delivery device according to claim 1, wherein the controller is configured to implement the pre-configured change for all aerosols designated as subsequent aerosols.

14. The aerosol delivery device according to claim 1, wherein the controller is configured to implement the pre-configured change for one or more of the first, second, third, fourth, fifth, sixth, seventh, eighth, ninth or tenth aerosols generated following a first aerosol.

15. The aerosol delivery device according to claim 1, wherein the controller is configured to implement the pre-configured change after a finite period of time has elapsed following the generation of the first aerosol.

16. The aerosol delivery device according to claim 1, wherein the controller is configured to implement the pre-configured change after a pre-defined cumulative period of aerosol generation.

17. The aerosol delivery device according to claim 1, wherein the controller has a fixed mode, wherein in the fixed mode, multiple successive aerosols are generated having substantially the same aerosol characteristics, or the controller has a stepped mode, wherein in the stepped mode, successive aerosols are generated having substantially different aerosol characteristics.

18. The aerosol delivery device according to claim 17, wherein the controller has a fixed mode and a stepped mode, wherein in the fixed mode multiple successive aerosols are generated having substantially the same aerosol characteristics, wherein in the stepped mode successive aerosols are generated having substantially different aerosol characteristics.

19. An aerosol delivery system comprising the aerosol delivery device of claim 1 and an article comprising one or more stores for retaining an aerosolizable material.

20. The aerosol delivery system according to claim 19, wherein the device comprises one or more aerosol generators, or the article comprises one or more aerosol articles.

21. A method of modulating an aerosol generated by an aerosol delivery system, the method comprising the steps of: providing an aerosol delivery device comprising a controller and a power source, the device comprising an article of aerosolizable material; generating a first aerosol; generating one or more subsequent aerosols, wherein the one or more subsequent aerosols contains a pre-configured change in one or more aerosol characteristics relative to the first aerosol, wherein the usage characteristic is a time interval between generation of the first aerosol and the subsequent aerosol.

* * * * *